United States Patent [19]

Sapkus et al.

[11] 4,246,722

[45] Jan. 27, 1981

[54] GROWING BABY DOLL

[75] Inventors: Jurgis Sapkus, Manhattan Beach; J. Stephen Lewis, Pacific Palisades; Raymond J. Douglas, Carson, all of Calif.

[73] Assignee: Mattel, Inc., Hawthorne, Calif.

[21] Appl. No.: 12,920

[22] Filed: Feb. 16, 1979

[51] Int. Cl.[3] ..... A63H 11/00

[52] U.S. Cl. ..... 46/120; 46/135 R; 188/185

[58] Field of Search ..... 46/119, 150, 120, 135 R, 46/264–266; 188/185

[56] References Cited

U.S. PATENT DOCUMENTS

| | | | |
|---|---|---|---|
| 1,261,528 | 4/1918 | Hess | 46/105 |
| 1,776,964 | 9/1930 | Aznak et al. | 46/119 |
| 1,792,426 | 2/1931 | Jabas | 188/100 |
| 2,147,215 | 2/1939 | Price | 46/150 |
| 2,288,371 | 6/1942 | Rothschild . | |
| 2,564,813 | 8/1951 | Moyers, Sr. | 46/119 |
| 2,565,603 | 8/1951 | Fraysur | 46/120 |
| 2,763,095 | 9/1956 | Stearns | 46/149 |
| 3,029,552 | 4/1962 | Katz . | |
| 3,147,566 | 9/1964 | Ong | 46/149 |
| 3,230,666 | 1/1966 | Gardel et al. . | |
| 3,375,600 | 4/1968 | Poulos . | |
| 3,390,481 | 7/1968 | Runanin | 46/119 |
| 3,710,506 | 1/1973 | Thornell | 46/118 |
| 3,745,696 | 7/1973 | Sapkus et al. . | |
| 3,808,735 | 5/1974 | Morrison . | |
| 3,812,613 | 5/1974 | Glass et al. . | |
| 3,828,469 | 8/1974 | Giroud | 46/118 |
| 3,992,807 | 11/1976 | Sapkus et al. . | |
| 3,995,394 | 12/1976 | Ayton . | |

*Primary Examiner*—Bernard Nozick
*Attorney, Agent, or Firm*—John G. Mesaros; Max E. Shirk; Ronald M. Goldman

[57] ABSTRACT

A baby doll having an extendable torso, an extendable neck, movable legs, and a mechanism for causing the torso and the neck to extend and the legs to straighten so that the doll appears to grow.

10 Claims, 6 Drawing Figures

FIG. 3
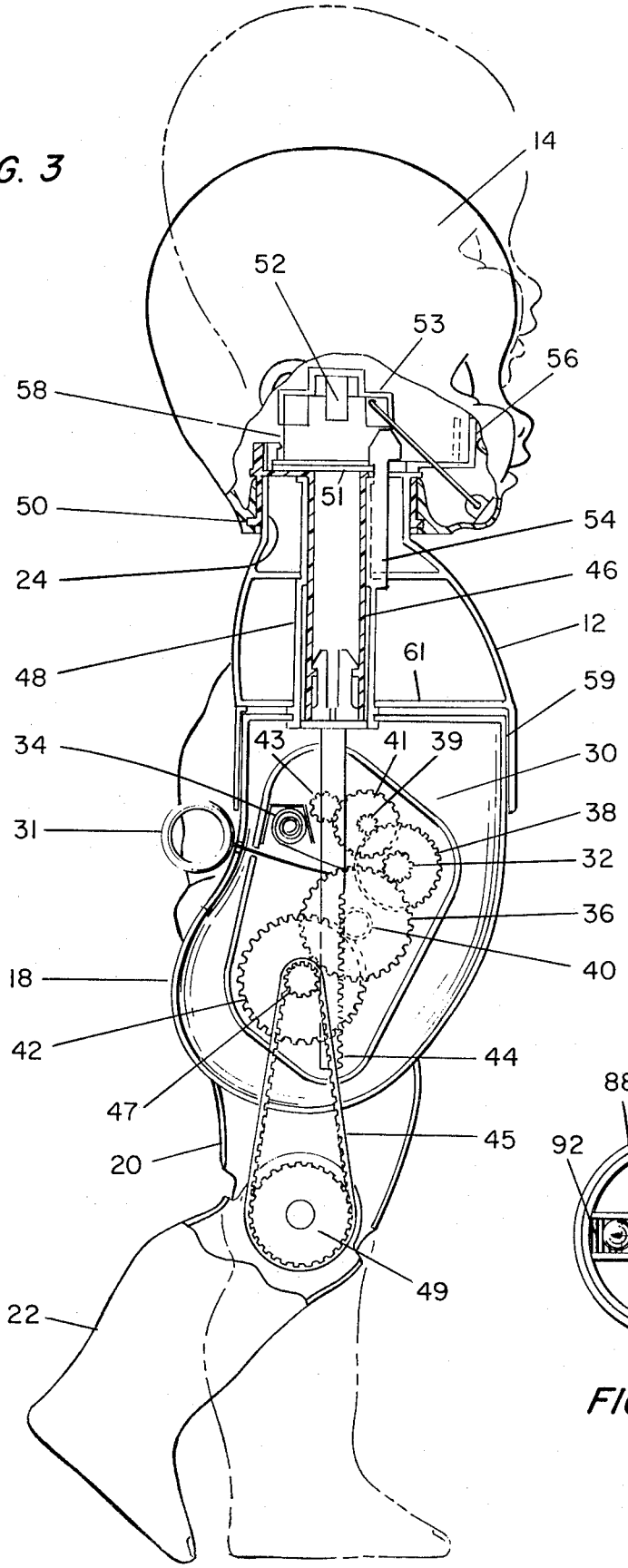
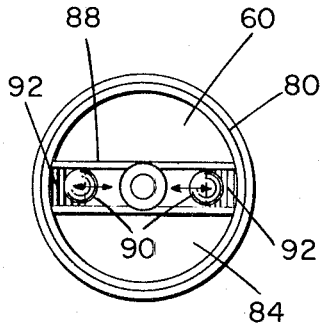
FIG. 6

GROWING BABY DOLL

BACKGROUND OF THE INVENTION

The background of the invention will be discussed in two parts:

1. Field of the Invention

This invention relates to toys and, more specifically, to baby dolls for preschool children.

2. Description of the Prior Art

There have been an uncountable number of toys designed for use by children. Any successful toy must be inexpensive, sturdy, and entertaining to the child. These criteria are especially important in toys designed for preschool children who are especially destructive and who develop so rapidly that they quickly lose interest in a toy. Another especially important requirement of toys for preschool children is that they must be operable by a child whose ability to manipulate is quite limited.

There have been many baby dolls designed for preschool children. Such dolls capture the attention of the child because of the child's desire to imitate its parents in nurturing a baby. A baby doll will attract and maintain the attention of a child for a relatively brief period of its life and will then be discarded. Attempts have been made to animate such dolls in order to provide more interest to the child and extend the life of the toy. To this end, various parts of baby dolls have been made movable. For example, arms, legs, eyes, and faces have been attached to mechanisms which cause them to move in various ways. Other dolls, not intended for the preschooler, have mechanisms which cause the doll to appear to grow and to become pregnant. These last-mentioned toys, however, have mechanisms which are too complicated for the preschool child to operate and are often too delicate to stand up to use by a preschool child.

It is an object of the present invention to provide a new and improved baby doll for preschool children.

It is another object of the present invention to provide a new and improved baby doll which appears to grow larger and to age when operated by the child.

SUMMARY OF THE INVENTION

The foregoing and other objects of the invention are accomplished in the present invention by a baby doll which has movable lower legs, an extendable torso, an extendable neck, and a mechanism for causing the legs to straighten while the neck and torso extend so that the doll appears to grow. In the preferred embodiment, the extendable torso includes an upper torso which overlaps a lower torso and means actuable by the mechanism to move the upper torso so that it overlaps the lower torso to a lesser extent. The same mechanism coincidentally causes the head to move to expose more neck and the lower legs to straighten. Thus, the doll appears to have its neck grow, its torso to extend in length, and its legs to lengthen at the same time. In the preferred embodiment the mechanism of the invention is a spring motor wound by a simple pull string and actuated by placing a bottle in the doll's mouth. Thus, the toy is easily operated by a preschool child with its limited mechanical ability.

Other objects, features, and advantages of the invention will become apparent from a reading of the specification when taken in conjunction with the drawings in which like reference numerals refer to like elements in the several views.

BRIEF DESCRIPTION OF THE DRAWINGS

FIG. 3 is a side view of the baby doll shown in FIG. 2 cut away to disclose a side view of the internal operating mechanism;

FIG. 6 is an enlarged side view of a governor which may be used with the mechanism of the invention.

DESCRIPTION OF THE PREFERRED EMBODIMENT

Figure 1:
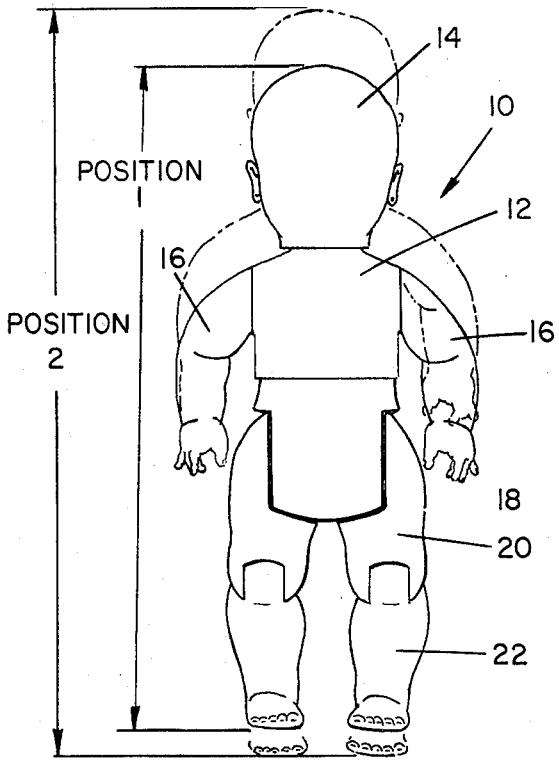
FIG. 1 is a front view in reduced size of a baby doll constructed in accordance with the invention showing the two positions which the toy may assume when operated.

Referring now to the drawings and, more particularly, to FIG. 1, there is shown in reduced scale, a baby doll 10 constructed in accordance with the invention. The baby doll 10 has an upper torso 12, a head 14, arms 16, a lower torso 18, thighs 20, and lower legs 22. The doll 10 is provided with an inner mechanism (not shown in FIG. 1) which actuates it to extend from the position shown in bold outline in FIG. 1 (hereinafter referred to as position 1) to a second position shown in dotted outline in FIG. 1 (hereinafter referred to as position 2). In position 2, the doll 10 appears to have a longer lower torso 18; and a neck 24 has appeared. Although not illustrated in FIG. 1, in a preferred embodiment, the lower legs 22 may also be extended so that the baby doll 10 appears to have grown.

Figure 2:
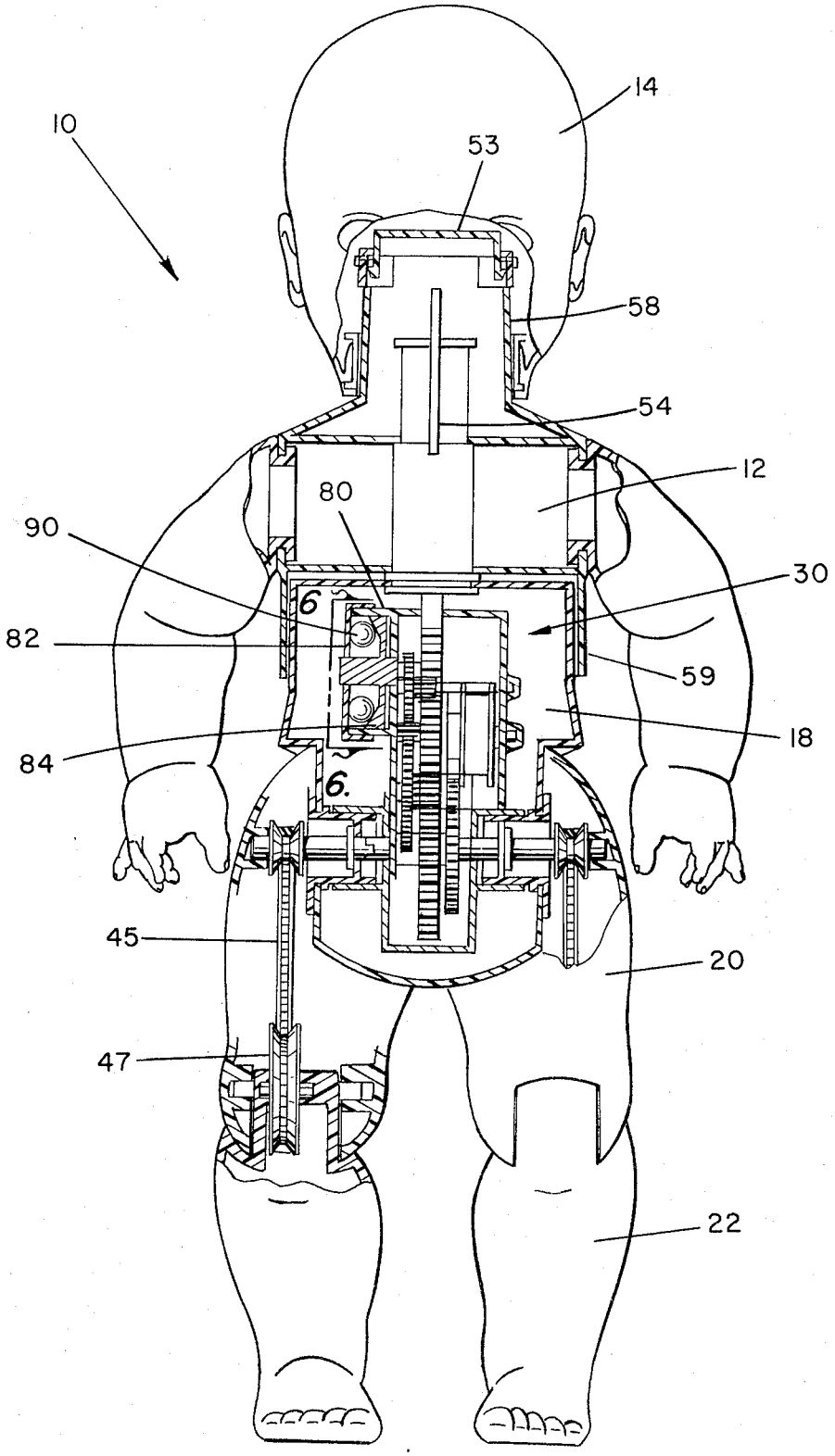
FIG. 2 is a front view of a baby doll constructed in accordance with the invention cut away to disclose the internal operating mechanism.

A preferred embodiment of the mechanism by which the doll 10 is caused to move from position 1 to position 2 and extend its lower legs 22 is better described in FIGS. 2 and 3. Referring to FIGS. 2 and 3, there is shown a baby doll 10 having upper torso 12 connected to a head 14 and a lower torso 18. The lower torso 18 mounts thighs 20 and lower legs 22. FIGS. 2 and 3 are both cut away to show an internal driving mechanism 30 which actuates the doll 10. This mechanism 30 includes a pull 31 which moves a gear 32 to wind a spring 34 about the axis of the gear 32. When the pull 31 is pulled away from the body of the doll 10, the gear 32 is rotated in a direction opposite that described by the arrows superimposed in FIG. 2; and the spring 34 applies a force on the gear 32 to move it in the direction of the arrow. Gear 32 engages a second gear 36 which is mounted coaxially with and affixed to a third gear 40. The gear 40 engages a rack 44 which causes the extension of the upper torso 12 and of the head 14 with respect to the neck 24.

The rotation of the gear 40 causes the rotation of a gear 42 connected to a pulley 47 which drives a belt 45 to rotate a pulley 49 affixed to the lower leg 22. The operation of the pulley 49 when the mechanism 30 is operated causes the lower leg 22 to extend forwardly as shown by the arrow in the drawing.

The rotation of the gear 32 also rotates a gear 38 (affixed to the same axis) which engages a first gear 39 to drive a second gear 41 mounted coaxially with gear 39 and affixed thereto. The rotation of the gear 41 drives a gear 43 which is attached to a governing mechanism 60 to be explained in detail hereinafter.

The operation of the mechanism 30 once the pull 31 has been withdrawn from the doll 10 causes the gears 32 through 43 to be operated in the directions shown by the arrows in FIG. 2, thereby driving the rack 44 upward, the pulley 49 in the direction shown and the lower leg 22 forward, and operating the governor 60 attached to the gear 43.

The rack 44 is directly connected to the base of a cylinder 46 which extends within the upper cylindrical tube 48 and is mounted to a head mount 50. The head mount 50 carries the head 14, is generally cylindrical in shape, and is positioned about the cylindrical neck 24. Consequently, the movement of the rack 44 upward drives the cylinder 46 upward causing the head mount 50 and the head 14 to slide upward over the neck 24 thereby causing the neck 24 to appear to extend in length and the head 14 to rise with respect to the lower body of the doll 10.

In position 1 shown in FIG. 3, the head mount 50 is retained in position by a latch 54 which fits through a surface of the mount 50 and is released by an actuator 56. The actuator 56 is part of an actuator mechanism 52 which includes a cap 53. The actuator mechanism 52 will be described hereinafter.

When the latch 52 is released and the spring motor drives the rack 44 upwardly causing the head mount 50 to move upwardly, the head mount 50 moves the head 14 upwardly extending the neck 24 until an upper edge of the head mount 50 abuts against a lower edge of the cap 53. This causes the cap 53 to be impelled upwardly by head mount 50 and stops the extension of the neck 24. The cap 53 is connected to the cylinder 58 and thereby to the upper torso 12 so that the upward movement of the cap 53 moves the cylinder 58 and the upper torso portion 12 upwardly. The movement of the upper torso 12 by the rack 44 causes a lower skirt 59 of the upper torso 12 to move upwardly with relation to the lower torso 18. This causes the body of the doll 10 to appear to grow. The upper movement of the lower skirt 59 with respect to the lower torso 18 continues until a flange 61 on upper torso 12 abuts against the lower edge of latch 54 thereby stopping the extension of rack 44 and the growth of the body of the doll 10.

Figure 5:
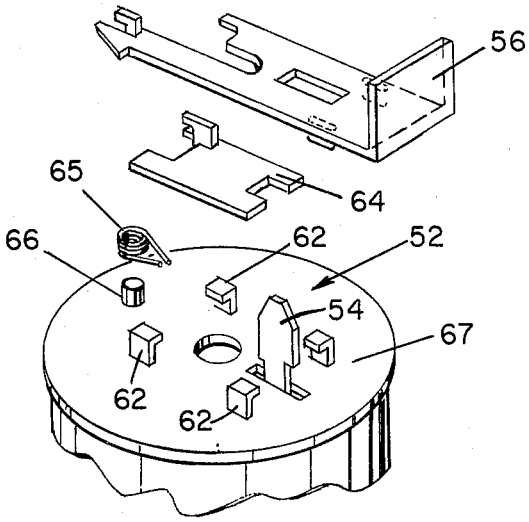
FIG. 5 is an exploded perspective view of a portion of the mechanism of the invention.

It may be seen that the actuator mechanism 52 which releases the spring motor after the pull 31 has been extended is operated by the inward movement of the actuator 56 in response to a bottle or the like placed in the mouth of the doll 10. The exploded view of FIG. 5 better describes the operation of the actuator mechanism 52. The mechanism 52 includes the actuator 56 which slides between four clips 62 and overlies a plate 64. A spring 65 fits over a post 66 and presses against actuator 56 and plate 64. As the pull 31 is operated to wind the spring motor, the rack 44 is driven downwardly pulling the head mount 50 over the latch 54 so that the plate 64 first displaces and then engages the lower left hand edge of latch 54. When the actuator 56 is pressed inwardly, it carries the plate 64 so the latch 54 is released and the plate 67 moves upwardly. At the same time, the right edge of the actuator 56 catches the upper right hand edge of the latch 54 and stops the latch 54 from releasing. The latch 54 is the released by withdrawing the bottle from the mouth of the doll 10 so that the spring 65 drives the actuator 56 in the right hand direction (as shown in FIG. 5). This double latch provides that the head 14 will not begin to move upwardly while a young child holds a bottle in the doll's mouth. Not until the bottle is withdrawn will movement begin.

The release of the latch 54 allows the plate 67 which is a portion of the head mount 50 to proceed upwardly causing the neck 24 and the upper torso 12 to extend.

Figure 4:
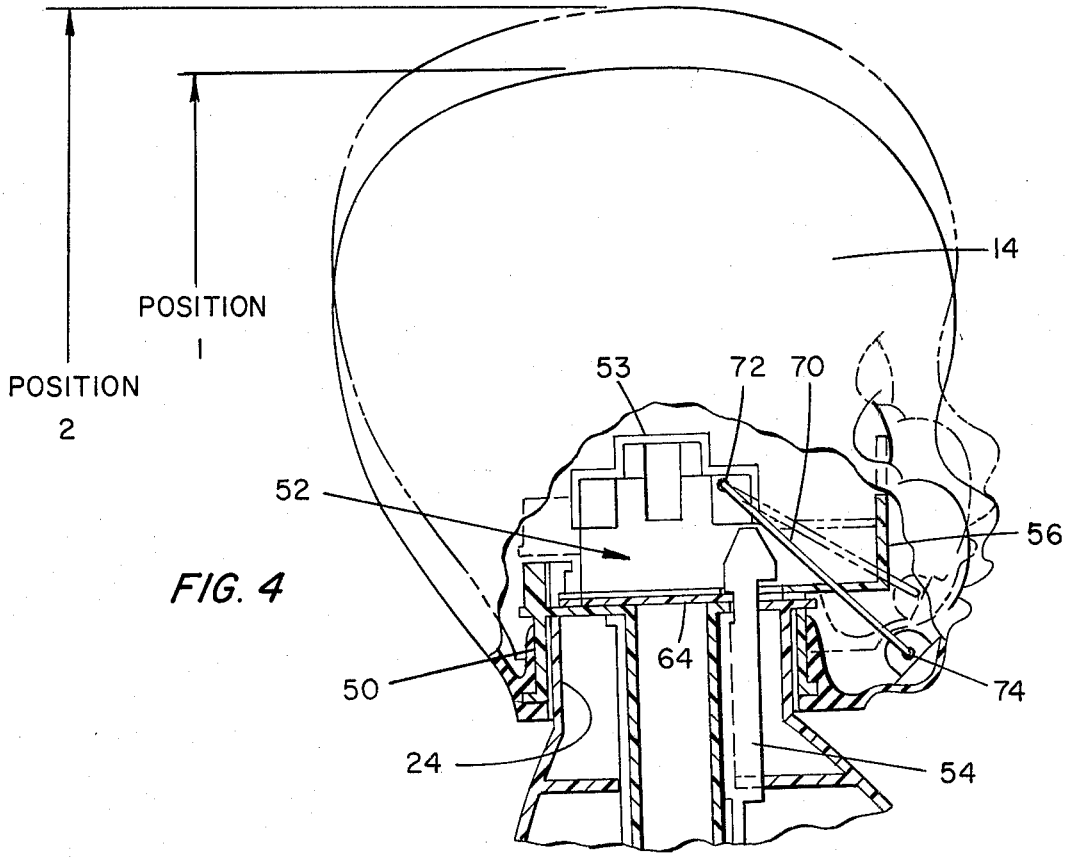
FIG. 4 is an enlarged side view of the head of baby doll shown in FIG. 2 cut away to show a portion of the operating mechanism.

The two positions of the head 14 relative to the neck 24 are more clearly illustrated in FIG. 4 which also shows in detail the position of the various elements of the actuator mechanism 52. As is illustrated, in position 1 (the lowered position) the head 14 rests so that the head mount 50 completely covers the neck 24. In position 2, the head mount 50 has moved upwardly so that a substantial portion of the neck 24 appears to view. Thus, the neck 24 appears to grow.

When the head mount 50 moves upwardly with respect to the cap 53, it urges a generally U-shaped wire 70 upwardly. The wire 70 is affixed at its ends to rotate in holes 72 in cap 53 so that it draws with it the chin of the doll to which it is secured at point 74. By moving the chin upwardly and outwardly, the face of the doll 10 is given a more jutting chin and its cheeks are pulled inwardly and become less rounded. Consequently, the doll 10 appears to become less a baby and more an older child.

In order to maintain the operation by which the mechanism 30 extends the body of the doll 10 at a relatively constant rate, a unique governor 60 is provided. The governor 60 is shown in FIG. 6 in enlarged form and in cross-section in FIG. 2. The governor 60 includes a circular housing 80 covered by a cap 82. Mounted for rotation on the axis of the gear 43 is a disk 84. The disk 84 carries two walls 86 and 88 which are perpendicular to its surface and define a cage for two bearings 90. The surface of the disk 84 within the walls 86 and 88 has a first flat portion and a second ramp portion extending outwardly in both directions, from the dotted lines 92 shown in FIG. 6.

In operation, the disc 84 rotates with the gear 43 urging the bearings 90 outwardly and up the ramps which begin at the lines 92. As the bearings 90 are urged up the ramps they come in contact with the cap 82 providing drag at the surface of the cap 82, on the surface of the ramps, and on the inner surfaces of the walls 86 and 88 to slow the mechanism 30 and maintain its rate relatively constant. If the mechanism 30 slows, the bearings 90 fall inwardly toward the axis of the disc 84 thereby relieving the drag and allowing the mechanism 30 to speed up. Consequently, the governor 60 maintains the mechanism 30 at a relatively constant speed.

The details of the construction of the various parts of the doll 10 will not be discussed in this specification because they are not believed to be pertinent to the invention. However, a general description of the constituents of the doll 10 is provided here to assist the reader. The skin used to cover the external parts of the doll 10 may preferably be of a material such as a soft vinyl foam well-known in the art and adapted to give an appearance to touch closely akin to that of the skin of a person. All of the internal portions of the mechanism including the actuator mechanism 52, the head mount 50, the various tubes and cylinders utilized in extending the body, the gears of the spring motor, the governor 60, and the like may be formed of a relatively hard plastic such as nylon by means such as molding, well known in the art. The bearings 90 should preferably be of steel or like material in a preferred embodiment. The pull 31 may be plastic and may be attached to a string of relatively sturdy construction. The spring 34 and the spring 65 are constructed of those materials normally used in the art to form springs. The U-shaped wire 70 may be constructed of any relatively stiff metal or plastic which does not bend in use.

The preferred manner of construction heretofore described obviously is not intended to limit the breadth of the invention and is not intended to be all inclusive.

It is believed that the foregoing description of a preferred embodiment of the invention is described in sufficient detail to enable one skilled in the art to make and use the invention. However, it is expressly understood that the invention is not to be limited to those details presented in describing the preferred embodiment inasmuch as other equivalent elements would suggest themselves to those skilled in the art upon reading this specification, and additions or improvements may be made which embody the invention herein described. Accordingly, it is respectfully requested that the invention be broadly construed within the full spirit and scope of the appended claims.

What is claimed is:

1. A baby doll comprising a lower torso portion, a pair of lower legs coupled to said lower torso portion, said pair of lower legs being capable of assuming a first bent position, an upper torso portion overlying said lower torso portion, said upper torso portion including a neck, a head positioned over the neck in a first position, motor means within one of said upper and lower torso portions, means responsive to operation of said motor means for simultaneously moving said pair of lower legs to a second position whereby they are straightened and moving the head to a second position with respect to the neck whereby the neck appears to elongate.

2. The combination according to claim 1 wherein said head includes means coacting with the face portion of said head and responsive to the movement of said head toward said second position for causing the face portion to elongate.

3. A baby doll as claimed in claim 1 in which the means responsive to operation of said motor means for moving the head comprises a head mount surrounding the neck, and means positioned within the neck for moving the head mount with respect to the neck; and which further comprises latching means for holding the head mount in a first position, and actuator means for releasing the latching means.

4. A baby doll as claimed in claim 3 in which said latching means comprises a latch having a first and a second catch, and in which said actuator means includes a first position for engaging the first catch, and a second position for engaging the second catch.

5. A baby doll as claimed in claim 4 further comprising means defining a first direction of operation for the actuator means whereby said actuator means moves from the first to the second position, and means defining a second direction of operation for the actuator to release the latch.

6. A baby doll as claimed in claim 1 in which the means responsive to operation of the motor means for moving the lower legs comprises first pulleys driven by the motor means, and second pulleys each driven by one of the first pulleys and connected to one of the lower legs.

7. A doll comprising a body having an upper portion and a lower portion, one of which portions fits over the other portion in a telescoping relationship; a pair of legs capable of assuming a bent position; a head having a face, means for coincidentally causing the face to lengthen, the pair of legs to straighten, and the upper portion and lower portions to move with respect to one another so that the body elongates.

8. A doll as claimed in claim 7 further comprising a neck over which the head fits, and means for elongating the neck while the legs straighten and the body elongates.

9. A baby doll comprising an extendable torso having an upper portion overlying the lower portion, said upper portion including a neck with a head positioned over the neck in a first position, means for moving the head to a second position with respect to the neck portion whereby the neck appears to elongate, a pair of lower legs capable of assuming a first bent position, means for straightening the lower legs, and motor means for causing said upper portion to move relative to said lower portion, said motor means including a motor, a rack driven by the motor, and a governor for controlling the speed of the motor.

10. A baby doll as claimed in claim 9 in which the motor comprises a spring motor, and in which said motor means further comprises a series of step down gears coupling the motor to the governor.

* * * * *